US006101768A

United States Patent [19]

Springstead et al.

[11] Patent Number: 6,101,768

[45] Date of Patent: Aug. 15, 2000

[54] CENTER SUPPORTED VENTILATED RAISED FLOOR WITH GRATED CORE

[76] Inventors: Gary Springstead, 1822 S. Robb St., Lakewood, Colo. 80232; Gary Meyer, 7765 Lewis St., Arvada, Colo. 80005; Guy Muller, 1643 Fleming Pl., York, Pa. 17404

[21] Appl. No.: 08/526,504

[22] Filed: Sep. 11, 1995

[51] Int. Cl.[7] ..... E04B 5/48

[52] U.S. Cl. ..... 52/126.6; 52/126.1; 52/180; 52/506.06; 52/507; 52/480; 454/334

[58] Field of Search ..... 52/126.6, 125.1, 52/126.1, 126.5, 126.7, 180, 506.06, 507, 508, 791.1, 793.1, 506.01, 480, 263; 248/664; 454/185, 186, 334; 472/48, 75, 76; 254/101

[56] References Cited

U.S. PATENT DOCUMENTS

| | | | |
|---|---|---|---|
| 3,100,624 | 8/1963 | Spiselman | 254/101 |
| 3,470,663 | 10/1969 | Tate . | |
| 4,244,768 | 1/1981 | Wiechowski et al. | 52/180 X |
| 4,319,520 | 3/1982 | Lanting et al. | 98/37 |
| 4,856,256 | 8/1989 | Tokuzo | 52/805 |
| 5,036,639 | 8/1991 | Micko | 52/180 X |
| 5,048,242 | 9/1991 | Cline | 52/126.6 |
| 5,074,085 | 12/1991 | Ueda | 52/126.1 X |
| 5,115,621 | 5/1992 | Kobayashi | 52/805 |
| 5,291,714 | 3/1994 | Wright et al. | 52/180 X |
| 5,386,670 | 2/1995 | Takeda et al. | 52/126.6 |
| 5,442,882 | 8/1995 | Repasky | 52/126.6 X |
| 5,477,649 | 12/1995 | Bessert | 52/263 |
| 5,483,776 | 1/1996 | Poppe | 52/126.6 X |

FOREIGN PATENT DOCUMENTS

| | | |
|---|---|---|
| 0 294 212 A2 | 12/1988 | European Pat. Off. . |
| 2 267 720 | 12/1993 | United Kingdom . |

OTHER PUBLICATIONS

Hitachi Metals Report No E–234.
USG/DONN Access Floor Systems Catalog, 1990.

*Primary Examiner*—Carl D. Friedman
*Assistant Examiner*—Timothy B. Kong
*Attorney, Agent, or Firm*—Chrisman Bynum & Johnson

[57] ABSTRACT

A raised floor panel is strengthened with a grated core. The working surface of the floor panel may be either solid or perforated. The floor panel is supported by a center pedestal that extends from a sub-floor. The angle of the panel can be varied by pivoting the platform of the pedestal that supports the floor panel. Two ventilation damping panels, surrounding the column of the pedestal, are connected together and may be positioned in several configurations to change the ventilation characteristics of the raised floor.

4 Claims, 5 Drawing Sheets

CENTER SUPPORTED VENTILATED RAISED FLOOR WITH GRATED CORE

This invention relates to raised access floors, and more specifically, to a raised floor panel that has a grated core, that is supported in its center by a pedestal, that may be ventilated by an adjustable damper, that may be height adjusted, and that may be inclined to form a ramp.

BACKGROUND OF THE INVENTION

Raised floors are commonly used to create a space between a sub-floor and the normal working environment of a room. The sub-floor is the surface that would serve as the floor of a room before a raised floor has been installed. The raised floor creates a new floor surface that is somewhat higher than the sub-floor. The space between the sub-floor and the raised floor is used to hold electrical wiring and fiber optic cables, to contain an air plenum chase, and more generally to contain anything that must be in a room but is more safely or conveniently enclosed in an area apart from the main area of the room.

Early manufacturers of raised floors attempted to meet the needs of the early computer industry, such as providing large amounts of space for cabling and effectively dissipating heat generated by the computers. One early cooling method was simply to cut holes in solid raised floor panels and place grilles over these holes. This method proved to be unsatisfactory as the grilles did not allow adequate air flow between the sub-floor area and the external room. Furthermore, the grilles could not support adequate loads and the rough surface of the grilles interfered with the smooth operation of wheeled devices, such as moving carts, that must frequently be rolled across a floor.

An advance in raised floor design occurred with the introduction of perforated panels. Perforated panels are created by placing numerous small holes in solid panels. Perforated panels allow better ventilation than solid panels and provide a smoother working surface and greater strength than grilles. A marked disadvantage of perforated panels is that they are not as strong as solid panels. Notably, newer applications of raised floors require strengths that standard perforated panels cannot provide.

A common method of constructing a raised floor panel is to construct the panel from several layers. A bottom pan is filled with a supporting layer made of wood, cement, resin, or other material, or the bottom pan may be left hollow. A top sheet covers the bottom pan and the supporting layer and forms the working floor surface. While such a design is stronger, quieter, and more cost efficient than a conventional single piece raised floor panel, designs using a bottom pan still have not achieved strengths necessary for some applications. Further, such designs tend to be overly physically heavy. Also, even though panel strength is improved by a bottom pan design, the perforated panels used with these designs must be structurally weakened in order to provide acceptable ventilation through the raised floor.

Several. variations of the bottom panel design have been developed. At least one manufacturer of raised floors has improved the strength of raised floors by running steel reinforcement beams beneath the perforated panels. However, raised floors constructed with this technique are still not strong enough to support the loads required by more recent applications. Furthermore, support beams decrease ventilation by blocking the perforations that lie over the beams. U.S. Pat. No. 5,115,621 of Kobayashi describes a panel including a bottom pan and a top sheet with discrete supporting props formed into either the bottom pan or the top sheet, with the top sheet and bottom panel crimped together. U.S. Pat. No. 4,319,520 of Lanting, et al. describes a panel including an articulated frame that surrounds an interfitted grid structure where notches in each grid member fit into notches in the perpendicular members. Lanting also describes a damper system where damping plates are attached to the frame of the floor panel. However, such damping plates cannot be adjusted when utilizing a center support pedestal.

The strength of a raised floor is affected by the method in which the raised floor panels are supported as well as by the intrinsic strength of the raised floor panels. The usual method to support a raised floor is to place a support pedestal under each corner of the floor panels. Innovations in raised floor support structures have focused on refinements in corner support systems. For example, U.K. Patent Application No. 2-267-720-A of Huang describes a system where the corner support pedestals are connected to one another by a grid. Another support system, described in U.S. Pat. No. 5,048,242 of Cline, includes stringers attached between support pedestals. Again, the pedestals support the panels at their corners, and additional support is achieved at the edges of the panels by the stringers. The panel centers, however, remain unsupported.

A desirable raised floor could support loads several times greater than present raised floors support. Additionally, the ventilation characteristics of the raised floors should be easily adjustable. Finally, it would be useful if the user could readily adjust the height of the raised floor and the angle between the sub-floor and the work surface. This would allow ramps to be created on the raised floor where none exist on the sub-floor, or for a flat surface to be created on a raised floor above a ramp on the sub-floor.

SUMMARY OF THE INVENTION

It is an object of the present invention to provide for a raised floor that has greater load bearing capabilities than present raised floors. It is another object of the present invention to allow for variable ventilation through the raised floor, including maximum ventilation rates greater than present raised floors may provide. A raised floor panel achieving these objects includes a frame, a grated support core, and a top sheet. The frame consists of four vertical edges joined to each other at right angles to form a square, with an inward protruding lower lip that receives the grated core and an outward protruding upper lip that supports the top sheet. The grated core is made of interconnected strips of material, preferably strips of steel welded together to form an integral grid.

The grated core has a square shape with a width and length so that it will snugly fit into the frame, with the upper surface of the grate flush with the upper edge of the frame. In a preferred embodiment, the frame, grated core, and top sheet are made of steel and are welded together.

The top sheet provides the working surface of the raised floor panel and fits over the frame and core. It is a square with a width and a length such that the perimeter of the top sheet extends slightly beyond the perimeter of the frame. The top sheet may be either solid or perforated. An optional wearing surface may be placed over the top sheet to provide a desired working surface specific to the needs of a user. For example, a conductive wearing surface may be used to reduce the build up of static electricity that could interfere with the manufacture of electronic components. A perforated top sheet will have an identically perforated wearing surface.

A raised floor panel constructed with a grated core is stronger than a raised floor panel constructed with a conventional hollow or filled core. Additionally, the frame of such a grated floor panel does not need a bottom pan. This allows for a reduction in the weight of a panel, and a reduction in the amount of material needed to construct a panel. Further, a grated core allows for essentially the same floor design to be used with either a perforated or a non-perforated top sheet, the only difference being whether the top sheet (and wearing surface) is perforated. Traditional raised floor designs require separate designs depending on whether the top sheet is perforated.

The present invention also includes a method and apparatus to support a raised floor panel. It is an object of the raised floor support apparatus to increase the load bearing capacity of the raised floor by providing center support to the raised floor panels as well as edge support. It is also an object of the raised floor supporting apparatus to allow the user to control the amount of ventilation between the area enclosed by the raised floor and the main work area above the raised floor. Another object of the raised floor support apparatus is to allow the user to determine the height of the raised floor and angle of the raised floor, so that ramps may be formed.

These objects are achieved by the present invention. In a preferred embodiment of the invention, a raised floor is supported by a center support subsystem that includes a pedestal having a base, a support post that fits into a receiving column that extends from the base, and a pivotable support plate. With the base of this pedestal fixed to the sub-floor and the column oriented upwards of the sub-floor, a raised floor panel may be placed directly on the support plate. The pedestal serves to provide a rigid connection between the sub-floor and the raised floor panel. The height of the raised floor may be selected by the user by adjusting the length of the support post that fits into the receiving column. The angle between the plane of the pedestal's support plate and the sub-floor may be adjusted by a pivot that links the support plate with the cylindrical column of the pedestal. By making this adjustment, the raised floor may be formed into a ramp.

A damper including two panels may be situated beneath a raised floor panel, to which the damping panels are mechanically attached. The supporting pedestal extends through a hole in the center of each damping panel so that the operation of the damper and of the supporting pedestal do not interfere with each other.

When a damper is used, a top damping panel is attached to the top sheet of a raised floor panel and is slidably attached to a bottom damping panel. The connection between the top sheet and the top damping panel is made by connecting rods that terminate at one end to the top sheet and extend through slots in the top damping panel. The rods continue through the bottom damping panel and terminate at their lower end with a tensioning device so that the distance between the raised floor panel and the bottom damping panel can be varied. The top damping panel is sandwiched between the raised floor panel and the bottom damping panel. By repositioning the connecting rods in the slots of the top damping panel, the location of the top damping panel may be varied in relation to the bottom damping panel.

Both dampers contain ventilation holes which serve to control the air flow between the areas above and beneath the dampers. Ventilation is controlled by adjusting the location of the top damping panel in relation to the bottom damping panel. In one position, the ventilation holes of the top and bottom dampers are perfectly aligned. As the top damping panel is repositioned, the top damping panel ventilation holes will become offset to the bottom damping panel ventilation holes. As the offset between the top and bottom dampers increases, the ventilation decreases.

DETAILED DESCRIPTION OF THE PREFERRED EMBODIMENTS

There are two aspects of the raised floor system of this invention: a framed-core floor panel, and a center support subsystem for the panels. In overview, each of these aspects will be discussed briefly here, and a more detailed discussion will follow.

Figure 7:
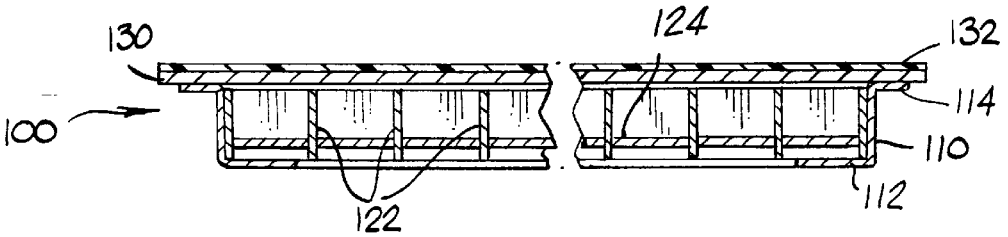
FIG. 7 is a cross-sectional side view of the floor panel shown in FIG. 6.
Figure 8:
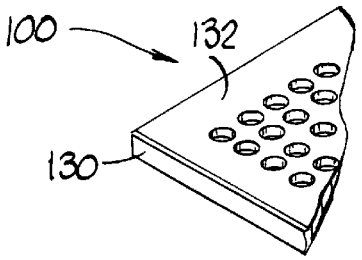
FIG. 8 is a view of a perforated top sheet and wearing surface.
Figure 6A:
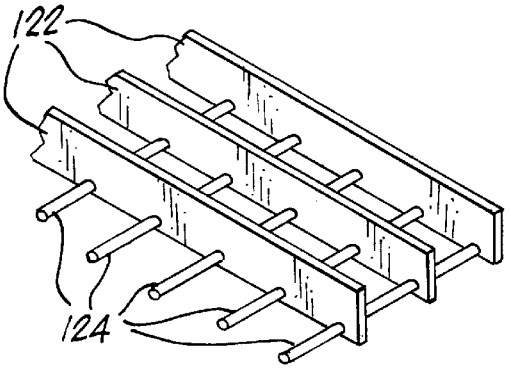
FIG. 6A is a schematic of the grated support core shown in FIG. 6.
Figure 6:
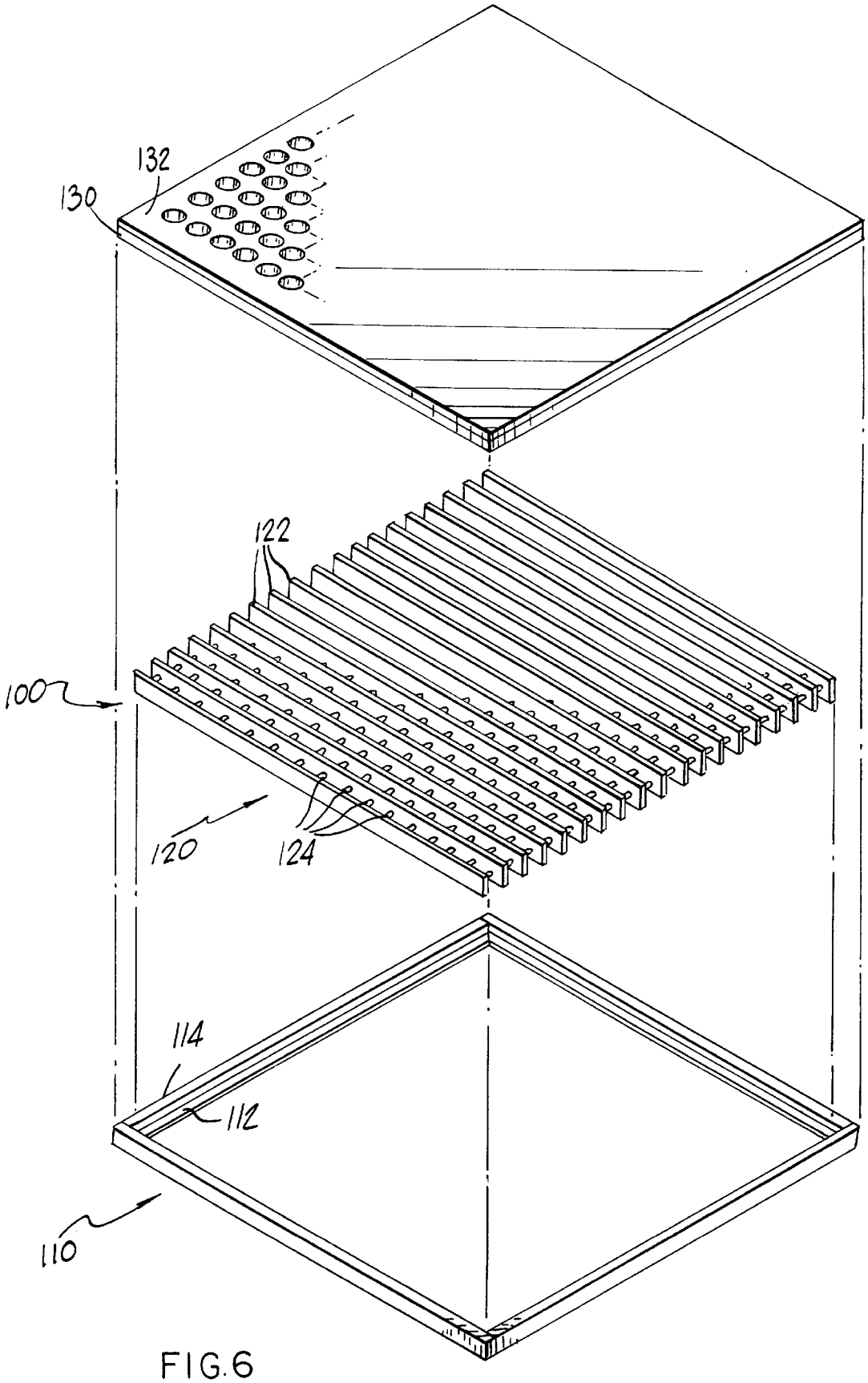
FIG. 6 is an exploded view of the floor panel of the present invention.

The first subsystem, the floor panel of this invention, may be understood with reference to FIGS. 6–8. With reference to FIG. 6, the floor panel 100 is of a three-part integrally welded design, including a frame 110, a specially constructed grated support core 120, and a top sheet 130, all designed to impart strength to the panel (as shown in FIG. 6, an optional wearing surface 132 may be placed above the surface of the top sheet 130). As will be explained in more detail later, the grated core 120 is integrally welded, includes a set of ties 122 held together by a set of cross-ties 124, and, as shown in FIG. 6A, has a gap between the cross-ties 124 and the top sheet 130. The floor panel of this design is substantially the same for both a solid panel and for a perforated panel, the only difference being that the top sheet of the perforated panel contains perforations while the top sheet of the solid panel does not.

The second subsystem, the center support apparatus including an associated damper for use with perforated floor panels, may be understood with reference to FIGS. 1–5. As seen, for example in FIG. 4, the center support apparatus includes a pedestal with a base 12; a support post and receiving column 13, 14; and a support plate 18. The support plate 18 contacts the panel 100 in the center of the panel, and is designed to prevent the deflection of the panel under heavy loading. The panel 100 may be a solid panel or a perforated panel. When a perforated panel is used, it is often desirable to include an adjustable damper for controlling the air flow, and the system of this invention includes a specially constructed adjustable damper including a bottom damping panel 20 (see FIG. 1) and a top damping panel 22, both of which cooperate with the pedestal support post and receiving column 13, 14 so that the advantages of the center support structure can be had, not only with a solid floor panel, but also with a perforated panel having an adjustable damper. Another advantage of the center support apparatus of this invention is that it can pivot (see FIG. 4B) so as to permit the formation of ramped floors.

It should be understood that each of these subsystems is independent of the other—that is, the panel subsystem of this invention may be used by itself with conventional support systems, and the center support subsystem of this invention may be used by itself with conventional panels. But while each of the subsystems has independent utility, and each subsystem stands alone as an improvement over conventional raised floors, it has been found that the combination of the two into a single system combines all of the benefits of both, achieving results beyond what either subsystem can achieve alone.

The foregoing summary is given as an overview only. In the more detailed explanation which follows, the panel subsystem will be discussed, and the center support will be discussed. Finally, the combination of the two subsystems into a single raised floor system will be explained.

RAISED FLOOR PANEL WITH GRATED SUPPORT CORE

A raised floor panel 100 constructed in accordance with the present invention is depicted in an exploded view in FIG. 6 and in a cross-sectional view through the center of the panel in FIG. 7. The panel includes a frame 110, a support grate 120, and a top sheet 130. The frame 120 consists of four vertical edges joined to each other at right angles to form a square. A lower lip 112 on the bottom of each edge extends horizontally towards the interior of the square and an upper lip 114 on the top of each edge extends horizontally away from the interior of the square.

The support grate 120 is an integrally welded grid composed of an array of members that are permanently attached to each other (see FIG. 6A). A first group of members 122 run parallel to each other and a second group of cross members 124 run parallel to each other but transverse to the members of the first group 122, so that a grate results. The second group of cross members 124 attach to the bottom of the first group so that top edges of the first group 122 are elevated above the second group 124. It is important that the members be securely joined to each other. In a preferred embodiment of the invention, the grate 120 and cross members 122, 124 are welded together. The grate 120 has a square shape with a width and length so that it will snugly fit into the frame 110. The depth of the grate 120 is such that when the bottom of the grate 120 rests on the lower lip 112 of the frame 110, the top of the first group of members 122 are level with the top of the upper lip 114 of the frame 110. The grate 120 is permanently attached to the frame 110 in that position. For maximum strength, the grate 120 is welded to both the top sheet 130 and the frame 110.

The top sheet 130 is a square with a width and a length such that the top sheet 130 will fit over the outwardly protruding upper lip 114 of the frame 110 and extend slightly beyond the upper lip 114. The upper lip 114 provides sufficient surface area for the top sheet 130 to be permanently attached to the frame 100, such as by welding. The top sheet 130 may be either solid or perforated (see FIG. 8). An optional wearing surface 132 may be placed over the top sheet 130 to provide a desired working surface. A perforated top sheet 130 will have an identically perforated wearing surface 132. The wearing surface 132 allows a user to select a material for the working surface of a raised floor that is suited to the user's needs. For example, a manufacturer of electronic components may desire a conductive wearing surface 132 to prevent the raised floor from developing a static charge.

In a preferred embodiment of the present invention, the frame 110 is manufactured from hardened steel that is 0.062 inches thick (see FIG. 7). It should be understood that all dimensions given are approximate and that the use of other dimensions may also result in an acceptable embodiment of the invention. The vertical edges of the frame 110 are 1 inch deep, the lower lip 112 is 1 inch wide, and the upper lip 114 is 0.5 inches wide. The transition bends from the lower lip 112 to the vertical edge and from the vertical edge to the upper lip 114 are chamfered 0.094 inches from the bends. The overall length and width of the frame, from the outside of the upper lip 114 on one side to the outside of the upper lip 114 on the opposite side, is 23.5 inches.

A preferred grated core 120 consists of two groups of twenty members that cross each other at right angles. The first group of members 122 are 1 inch deep and 3/16 inches thick. The second group of cross members 124 are welded to the bottom edges of the first group 122. The two groups of members 122, 124 are evenly spaced from each other so that the exterior dimensions of the grid is 22.875 inches. The cross members are manufactured of commercial grade steel.

A preferred top sheet 130 is a 24 inches by 24 inches square of 0.12 inches fully hardened steel, with a wearing surface 132 of 0.062 to 0.08 inches of NORA or MIPOLUEM-brand conductive tile. If the top sheet 130 is perforated, the holes are circles width 0.375 inches diameters spaced 0.5 inches each apart from each, measured from center to center (see FIG. 8). A 1 inch perimeter surrounds the top sheet 130 that is left free from perforations.

A preferred embodiment of the present invention can far exceed the current industry strength standards. The Ceilings & Interior Systems Construction Association (CISCA) has devised several tests to measure the strength of a raised floor, published in Ceilings & Interior Systems Construction Association, *Recommended Test Procedures for Access Floors* (1987). In a concentrated load test, a raised floor panel is loaded by a 1 inch square steel indentor in the center of the panel, at an edge of the panel, and at the panel's weakest point. The load applied is the manufacturer's rated design load. The temporary and permanent deflection of the panel under the load is measured. Current solid raised floors can typically support concentrated loads of 1250 pounds. The raised floor panel with grated core can support concentrated loads of 3500 pounds with either a solid or perforated top sheet.

A second test is the ultimate load test, which determines the maximum load that a raised floor can withstand without collapsing. The test is performed in the same manner as in the concentrated load test, except that a greater load is applied. A typical solid panel can support an ultimate load of 2500 pounds. The raised floor panel with grated core can support ultimate loads of 8500 pounds with either a solid or perforated top sheet.

In addition to its improved load-bearing capabilities, the perforated floor panel 100 of the present invention provides superior ventilation characteristics when compared with conventional perforated floor panels. An above described preferred floor panel 100 with a perforated top sheet 130 allows for the holes to occupy approximately 40 per cent of the top panel sheet 130. This may be compared to conventional perforated raised floor panels that are typically about 25 per cent holes. A preferred top sheet 130 allows a minimum air flow of 750 cubic feet per minute. This is substantially more air flow than is provided by current raised floor panels. The increase in air flow allows for a higher ratio of solid panels to be used in a raised floor made of a combination of solid panels and perforated panels than can be used with previous raised floor panels while maintaining the same air flow. This is advantageous as solid floor panels are somewhat stronger than perforated panels and allow for smoother operation of wheeled carts, and may be more aesthetic in that the user of the floor will not be subjected to unsightly cables contained beneath the raised floor.

CENTER SUPPORT PEDESTAL WITH DAMPER

Figure 1:
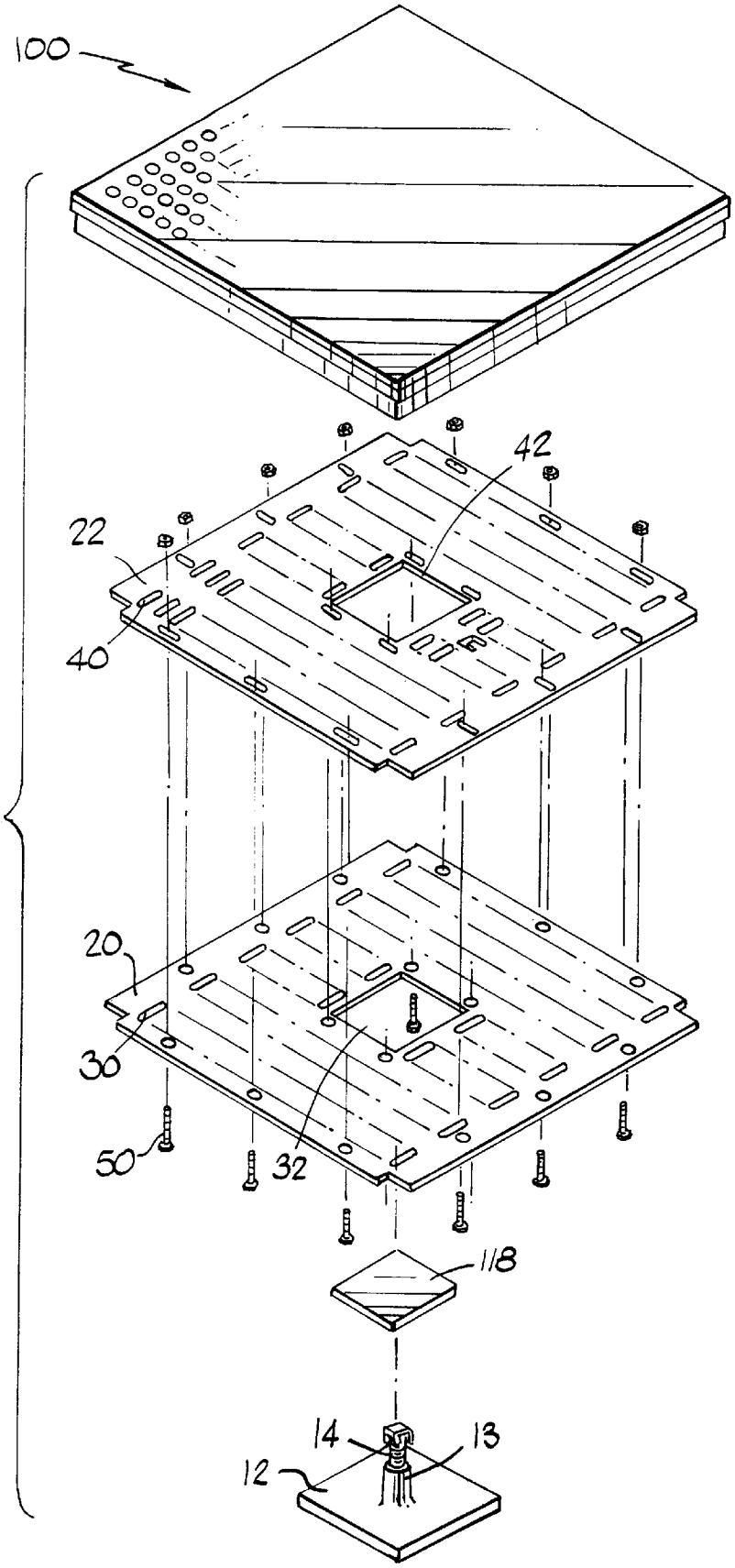
FIG. 1 is a perspective view of a raised floor panel and supporting apparatus in accordance with the present invention.

With reference to FIG. 1, it can be seen that the center supported adjustable angle raised floor with damper includes a pedestal base 12 placed on a sub-floor with a cylindrical receiving column 13 and a support post 14 extending perpendicularly above the sub-floor. A pivotable support plate 18 attaches to the end of the support post 14 opposite the sub-floor. A raised floor panel 100 may be placed on the support plate 18. As disclosed in detail below, the support plate 18 may be pivoted around the support post 14 to vary the angle formed between the plane of the support plate 18 and the sub-floor, thus allowing a ramp to be formed in the raised floor.

Figure 2:
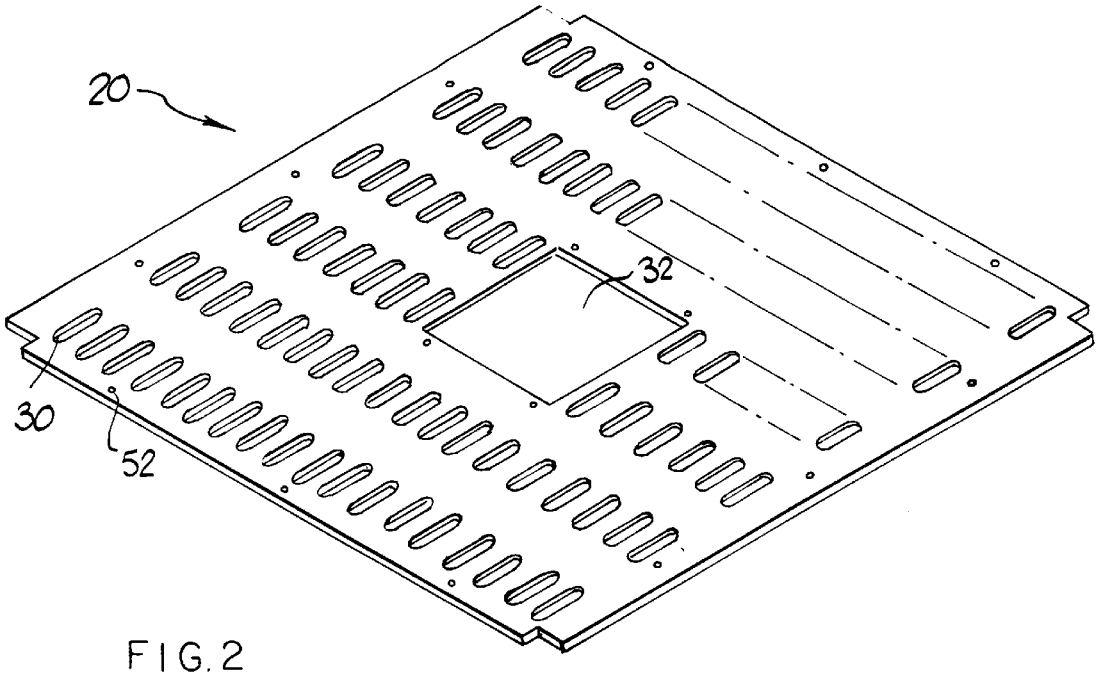
FIG. 2 is a top view of the bottom damping panel shown in FIG. 1.
Figure 3:
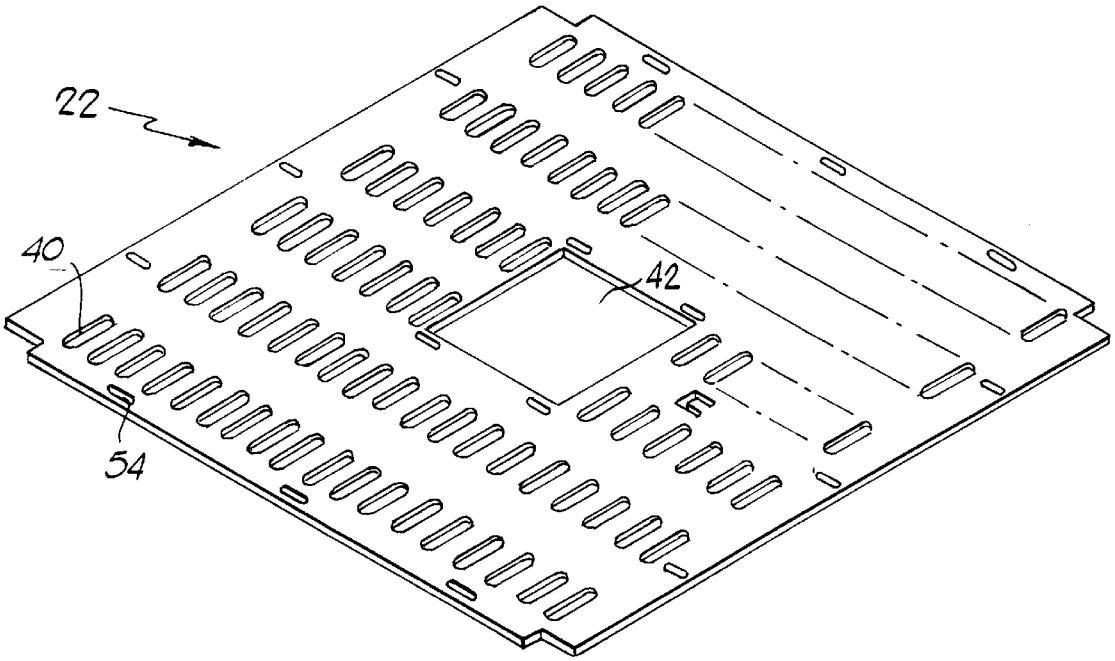
FIG. 3 is a top view of the top damping panel shown in FIG. 1.

A bottom damping panel 20 is situated between the sub-floor and the support plate 18; a top damping panel 22 is situated between the bottom damping 20 and the support plate 18. With reference to FIG. 2, it can seen that the bottom damping panel 20 is punctured with an array of ventilation holes, an example of which is lower ventilation hole 30. In a preferred embodiment of the invention, the holes are essentially rectangular in shape and have rounded corners. The ventilation holes may be regularly arranged across the bottom damping panel 20 so that the holes 30 form an array of six columns and nineteen rows. A larger support post hole 32 exists in the center of the bottom damping panel 20, through which the support post 14 extends. In a preferred embodiment, the column hole 32 occupies the area including the five middle rows and the two middle columns. Clearly, separate ventilation holes do not exist within that portion of the bottom damping panel 20.

The top damping panel 22 has the same external dimensions as the bottom damping panel 20. Ventilation holes, an example of which is upper ventilation hole 40, and an upper support post hole 42 are placed in the top damping panel 22 in the same relative locations as the ventilation holes. 30 and the column hole 32 of damping panel 20.

The top damping panel 22 is held in place by attaching it to the top sheet 130 of a raised floor panel 100 with a plurality of connecting rods, an example of which is rod 50. A preferred embodiment uses sixteen rods, where three rods attach close to each of the four outside edges of bottom damping panel 20 and one rod is located near each of the four corners of support column hole 32. Each rod is fixed to the top sheet 130. In a preferred embodiment, the rods are threaded and mate with matching threads in countersunk holes in the top sheet 130. The connecting rods pass through associated attachment slots on the top damping panel 22, such as representative attachment slot 54. The rods continue through attachment holes on the bottom damping panel 20, such as representative attachment hole 52. The rods may be fixed to the attachment holes of the bottom damping panel 20 by a head on the end of each of the rods, so that the rods act as bolts.

The attachment slots of the top damping panel 22 allow for the position of the top damping panel 22 to be varied with respect to the raised floor panel 100 and the bottom damping panel 20. The raised floor panel 100 and the bottom damping panel 20 remain fixed with respect to each other. The position of the top damping panel 22 is determined by the portion of the attachment slot through which a connecting rod passes. For example, in one position the top damping panel 22 could be placed so that each of the rods fit against one of the ends of each rod's associated attachment slot. In a second position, the top damping panel 22 could be positioned so that each rod fits through the center of its attachment slot. In a third position, the top damping panel 22 could be positioned so that each rod fits against the end of its associated attachment slot that is opposite the end described in the first position.

Repositioning the top damping panel 22 is accomplished by sliding the top damping panel 22 so that the rods extend through a different section of the attachment grooves. A U-shaped groove 58 is positioned in the top damping panel 22 to facilitate adjustment. A rigid arm contoured to fit into the U-shaped groove 58 may be inserted into the groove. The top damping panel 22 may be repositioned by applying force in the direction of the long axis of the attachment slots. Note that the top damping panel 22 may be repositioned by a user from above the surface of the raised floor panel 100, by inserting any rigid device (such as a screwdriver) through the a perforation in the top sheet 30 to apply force to the top damping panel 22.

The attachment slots are located on the top damping panel 22 in such a way that when the rods are fitted against one of the ends of their associated attachment slots, each ventilation hole on the top damping panel 22 lies directly over a ventilation hole on the bottom damping panel 20. As the top damping panel 22 is repositioned so that the rods attach to points closer to the opposite ends of the attachment slots, the ventilation holes on the top damping panel 22 become offset relative to the ventilation holes on the bottom damping panel 20. The amount of offset may be controlled by varying the position of the top damping panel 22.

The ventilation characteristics of the center supported raised floor will vary with the degree of offset between bottom damping panel 20 and top damping panel 22. Maximum ventilation will occur when there is no offset between the dampers and minimum ventilation will occur when the ventilation holes of the top damping panel 22 are fully offset from the ventilation holes of the bottom damping panel 20. The distance between the top damping panel 22 and the bottom damping panel 20, determined by the length of the connecting rods, should be minimized to achieve optimum damping. If the distance is not minimized, then air would easily pass through the damping system even when the dampers were offset from each other. When the distance between the dampers is minimal, however, the top and bottom dampers will act as one solid plate when they are offset from each other and will thus reduce ventilation through the raised floor panel 100. The distance between the top damping panel 22 and the bottom damping panel 20 is minimized by tensioning the tensioning device on each rod that passes through a connecting hole of the bottom damping panel 20 so that top damping panel 22 is firmly sandwiched between the bottom damping panel 20 and the raised access floor 100. This also prevents the top damping panel 22 from accidently sliding in relation to the bottom damping panel 20. The tensioning devices on the bottom damping panel 20 may be tensioned so that the dampers will not slide in relation to each other from the normal forces acting on the panel 100, but may be adjusted without excessive difficulty when desired. In a preferred embodiment, the tensioning devices are countersunk receptacles in the bottom of the top sheet 130.

Figure 4:
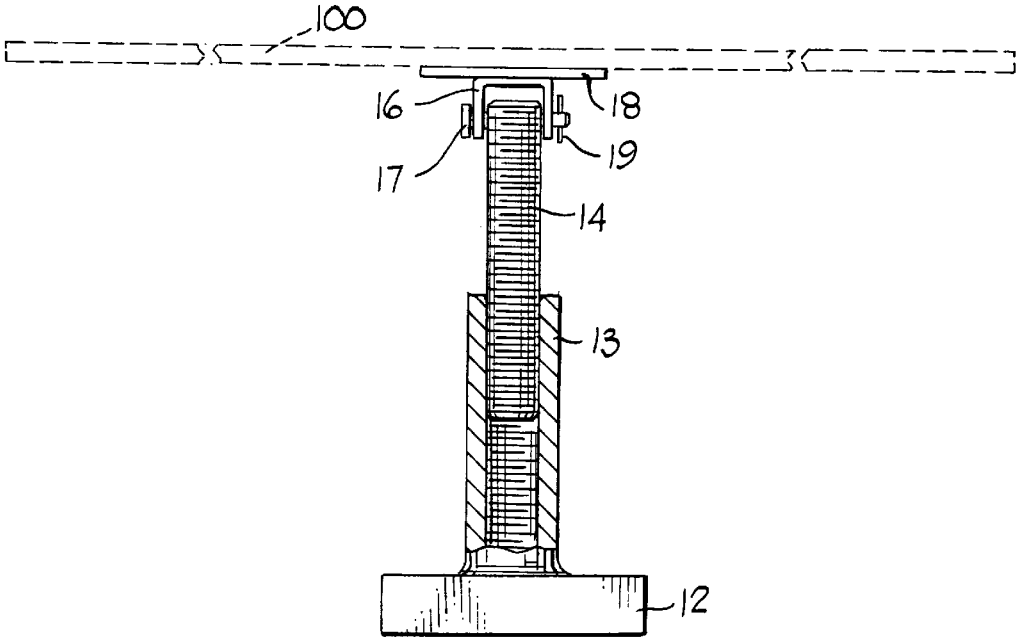
FIGS. 4, 4A, 4B, 4C, 4D, and 4E are views of the center support apparatus shown in FIG. 1 showing details of a pivoting support plate.
Figure 4A:
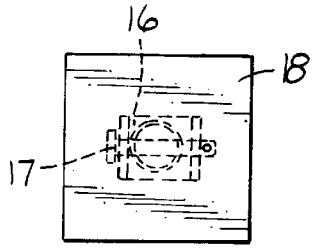
Figure 4B:
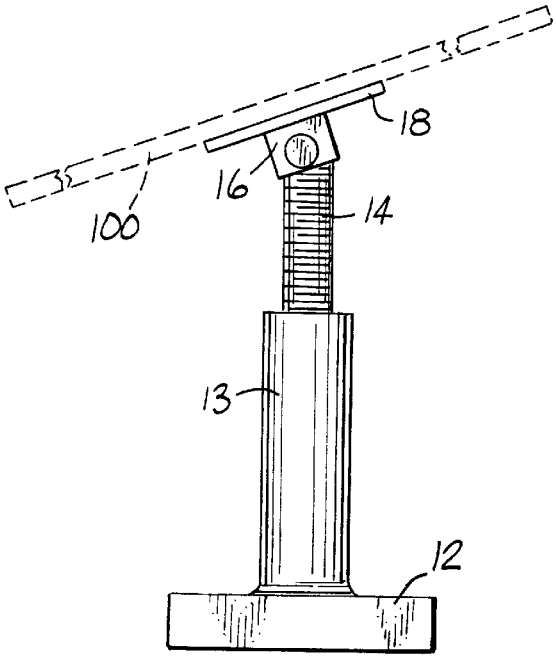

With reference to FIG. 4, the operation of a preferred embodiment of the center support pedestal may be understood. A pedestal base 12 sits on a sub-floor. An integrally formed receiving column 13 extends vertically from the pedestal base 12. A support post 14 fits into the receiving column 13 so that the post 14 extends above the column. The length of post 14 that is received into the column 13 may be adjusted so that the height of the upper end of the post 14 above may be selected by a user. In a preferred embodiment, threads in the post 14 mate with threads in the column 13 so that the post 14 may be screwed into the column 13 to a desired depth.

Figure 4C:
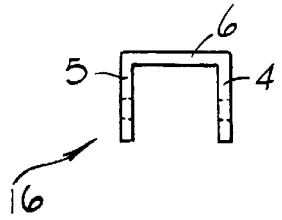
Figure 4D:
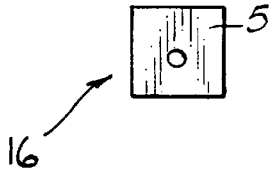
Figure 4E:
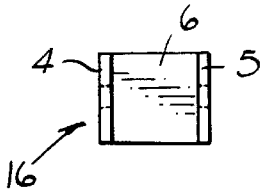

A pedestal head including an integral pivot channel 16 and support plate 18 is pivotally attached to the post 14. The pivot channel 16 is a "U" shaped bracket that has two identical parallel side walls 4, 5 connected by a third wall 6 (see FIGS. 4C, 4D, and 4E). When the pivot channel 16 is in its horizontal position, the third wall 6 is situated over the top of the support post 14 and the two side walls 4, 5 extend down over the upper portion of the support post 14 so that the third wall 6 is perpendicular to the axis of the support post 14. The pivot channel 16 is pivotably attached to the support post 14. In a preferred embodiment of the invention, pivoting is enabled by a pin 17 which penetrates the support post 14 and the two side walls 4, 5 of the pivot channel 16. The pivot channel 16 may rotate about the pin 17 so that the third wall 6 of the pivot channel 16 is no longer perpendicular to the axis of the supporting post 14 (see FIG. 4B). The pivot channel 16 may be fixed in relation to the support post 14 by attaching a cotter 19 through a hole in the pin 17.

A support plate 18 is integrally attached to the third wall 6 of the pivot channel 16. The support plate 18 is a rectangular plate of larger area than the third wall 6 of the pivot channel 16 and sits above the third wall 6 so that the perimeter of the pivot channel 16 extends beyond the perimeter of third wall 6 of the pivot channel 16. The purpose of the support plate 18 is to provide a platform to support a raised floor panel 100. The support plate 18, and hence the raised floor panel 100, will form an angle with the sub-floor that varies as the pivot channel 16 is pivoted about the support post 14. Attaching the cotter pin 19 fixes the support plate 18 and the raised floor panel 100 at a desired angle. A raised floor panel 100 attached to the support plate 18 can be formed into a fixed ramp of a desired angle (see FIG. 4B), or, of course, can be fixed parallel to the sub-floor to provide a flat raised floor.

Figure 5:
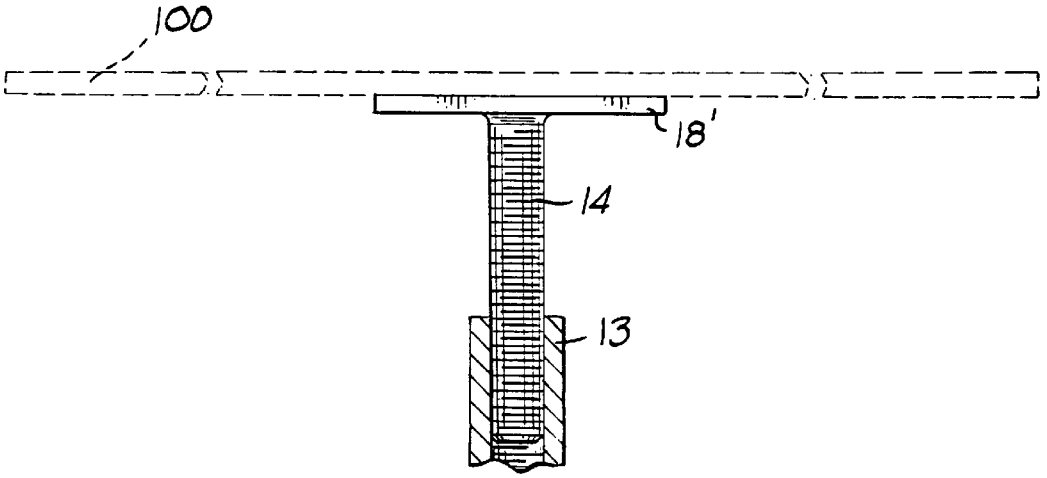
FIG. 5 is a view of a second embodiment of the center support apparatus showing details of a fixed support plate, as described in the present invention.

An alternate design of the center support pedestal does not include a pivot (see FIG. 5). In the alternate design, the center support post 14 is identical to the center support post hereinabove described. However, the alternate center support post 14 directly supports an integral support plate 18'. The support plate 18' is a rectangular plate that is perpendicular to the axis of the support post 14 and may support a raised floor panel 100 so that the raised floor panel 100 will be parallel with the sub-floor.

In a preferred embodiment, the dimensions of the damping panel and center support pedestal are designed to support a raised floor panel that has a 2 foot by 2 foot square upper surface, such as the preferred grated core raised floor panel 100 described above. The dimensions of the top damping panel 22 are described with reference to FIG. 3. The top damping panel 22 is a rectangle of approximately 1 foot 10¼ inches by 1 foot 9¾ inches. The corners of the rectangle are truncated so that a rectangular void of approximately 1 inch by 1⅛ inches is present at each corner. The ventilation holes are approximate rectangles of 2⅜ inches by ½ inches, with rounded corners of radius ¼ inches. The center hole 42 is a 6⅛ inches by 4¾ inches rectangle. The attachment slots are approximate rectangles of ¾ inches by ¼ inches, with rounded corners of radius ⅛ inches. The connecting rods are cylinders with a diameter of approximately ⅛ inches, which will snugly fit into the rounded corners of the ends of the attachment slots. The ⅛ inches diameter of the connecting rods allow the rods to travel at least ½ inches in the attachment slots, so that ventilation holes in the upper and lower damping panels 20, 22 may range from fully aligned or fully offset with each other. With reference to FIG. 4, the bottom damping panel 20 has similar dimensions to the top damping panel 22, except that ⅛ inch attachment holes replace the attachment slots. The exterior dimensions of the damping panels 20, 22 are less than the 24 inch by 24 inch floor panel 100 so that the top damping panel 22 will not extend beyond the perimeter of the floor panel 100 no matter how it is offset from the bottom damping panel 20. Thus, two raised floor panels with dampers may be located next to each other without the dampers interfering with each other.

Preferred dimensions of the pedestal unit including the receiving column 13, the support post 14, pivot channel 16, support plate 18, pin 17 and cotter 19, may be understood with reference to FIG. 4. The support post 14 is a 5 inches long, ⅜ inches diameter threaded solid steel stud. A 0.21 inch diameter hole is place in the post 14, with the center of the hole 0.375 inches below the top of the post 14. The two parallel walls 4, 5 of the pivot channel 16 are 1 inch by 1 inch squares, with a 0.21 inch hole placed so that the center of the hole is 0.375 inches above the bottom of each parallel side, and 0.5 inches away from the sides of each parallel side. The third wall 6 is 1 inch by 1.25 inches. The edge connections between the third wall 6 and the first two walls 4, 5 of the pivot channel 16 are rounded with an interior radius of 0.125 inches. The support plate 18 is 3 inches by 3 inches. The three walls of the pivot channel 16 and support plate 18 are made of 0.177 inches hardened steel.

A preferred dimension of the fixed support plate 18' is a 5 inch by 3.875 inch rectangle. As may be readily understood, the advantages of the invention may be retained when varying dimensions are substituted for those given.

RAISED FLOOR PANEL WITH GRATED CORE AND DAMPER SUPPORTED BY CENTER PEDESTAL

A raised floor panel constructed with a grated core may by supported using conventional techniques. The conventional method of supporting a rectangular raised floor panel is to support the panel with a pedestal at each of its four corners. However, such a support system will not allow the load bearing capabilities of a grated core panel to be fully exploited.

For optimum strength, a grated core floor panel of the present invention is supported by a pedestal at each of its four corners and by a center support pedestal of the present invention. The load bearing capabilities of a grated floor panel with a center support pedestal are greater than those listed when the floor panel is only supported at its corners. Because the use of center support pedestals in unknown in the prior art, there are no standard tests to measure the strength of a raised floor supported by a center panel. However, a grated core raised floor panel of the present invention supported with pedestals at the corners of the floor panel and a center support pedestal is much stronger than a similar floor panel supported only at its corners.

Additionally, it should be apparent that the center support pedestal and the damper disclosed may be used independently of one another and may be used with a raised floor panel with or without a grated core. Maximum load bearing capabilities and ventilation, however, are obtained when a raised floor panel with a grated core is used in conjunction with a center support pedestal and damper.

What is claimed is:

1. A raised floor support system, comprising:

(a) a support post attached at one end thereof to a base on the subfloor; and (b) a support plate connected to the other end of the support post, the support plate supporting a floor panel above the subfloor near the center of said panel;

wherein the floor panel is a perforated panel, and further comprising a damper operatively attached to the floor panel, the support post passing through the damper.

2. The system of claim 1 wherein the damper includes a first damping panel and a second damping panel, at least one of which is movable relative to the other, the support post passing through each of the damping panels.

3. A raised floor system, comprising:

(a) a floor panel, said floor panel having a frame, a support grate, and a perforated top sheet; the grate having a bottom flange and a top flange; the support grate being enclosed by the frame and the bottom flange thereof, said support grate having a plurality of grate strips and a plurality of cross-ties joined to the strips; and the top sheet being connected to both the strips of the support grate and the top flange of the frame; wherein the cross-ties are spaced apart from the top sheet, leaving a gap between the cross-ties and the top sheet;

(b) a center support apparatus, said apparatus having a support post attached at one end thereof to a base on the subfloor, and a support plate connected to the other end of the support post, the support plate supporting the floor panel above the subfloor near the center of said panel; and (c) a damper operatively attached to the floor panel, the support post passing through the damper.

4. The system of claim 3, wherein the damper includes a first damping panel and a second damping panel, at least one of which is movable relative to the other, the support post passing through each of the damping panels.

* * * * *